United States Patent [19]

Sustarsic et al.

[11] 3,930,961

[45] Jan. 6, 1976

[54] HOODED QUENCHING WHARF FOR COKE SIDE EMISSION CONTROL

[75] Inventors: John D. Sustarsic, McKees Rocks; Ronald O. McClelland, Pittsburgh, both of Pa.

[73] Assignee: Koppers Company, Inc., Pittsburgh, Pa.

[22] Filed: Apr. 8, 1974

[21] Appl. No.: 458,680

[52] U.S. Cl. ..... 202/227; 110/177; 202/263

[51] Int. Cl.[2] ..... C10B 39/04; C10B 27/00

[58] Field of Search ..... 202/227, 228, 262, 263; 110/173 R, 176, 177; 49/136, 362

[56] References Cited

UNITED STATES PATENTS

| | | | |
|---|---|---|---|
| 892,865 | 7/1908 | Mekeel | 110/177 |
| 2,072,392 | 3/1937 | West et al. | 202/262 |
| 3,547,782 | 12/1970 | Schon | 202/228 X |
| 3,652,403 | 3/1972 | Knappstein et al. | 202/263 X |
| 3,721,609 | 3/1973 | Spindeler | 202/263 X |
| 3,809,619 | 5/1974 | Drebes et al. | 202/228 X |
| 3,817,840 | 6/1974 | Stender | 202/262 X |
| 3,843,461 | 10/1974 | Allen | 202/227 |
| 3,844,901 | 10/1974 | Roe et al. | 202/227 X |

*Primary Examiner*—Joseph Scovronek
*Assistant Examiner*—Arnold Turk
*Attorney, Agent, or Firm*—Sherman H. Barber; Olin E. Williams; Oscar B. Brumback

[57] ABSTRACT

A shed encloses a coke wharf onto which hot coke is pushed, the coke cake passing through a coke guide into the shed. Doors in the shed are disposed opposite the coke oven chambers and each door is openable when a coke guide is positioned at an oven to be pushed. Deflector means are located inside the shed at each door that break up and spread the coke onto the coke wharf. Fumes that evolve from the coke on the wharf as it is being quenched are collected in a main. An auxiliary collecting main and hood structure are located above the coke oven doors, whereby effluent arising from coke in the chambers after the oven doors are removed are collected in the auxiliary collecting main and conducted thence into the collecting main.

8 Claims, 4 Drawing Figures

HOODED QUENCHING WHARF FOR COKE SIDE EMISSION CONTROL

BRIEF SUMMARY OF THE INVENTION

In apparatus for quenching hot coke pushed from coke oven chambers through a coke guide onto a coke wharf from which a rotary plow removes the coke onto a belt conveyor, the improvement comprising an enclosure covering the coke wharf and having doors opposite the coke oven chambers. Means are provided for opening and closing a door in the enclosure when a coke guide is aligned with an oven to be pushed. At least one movable structure is disposed within the enclosure and it carries a plurality of nozzles that emit water that quenches the coke as it falls and resides on the coke wharf. Deflector means are provided within the enclosure at each door to break up and deflect the coke cake as it enters the enclosure.

For a further understanding of the invention and for features and advantages thereof, reference may be made to the following description and the drawing which illustrates a preferred embodiment of equipment in accordance with the invention.

DETAILED DESCRIPTION

Figure 1:
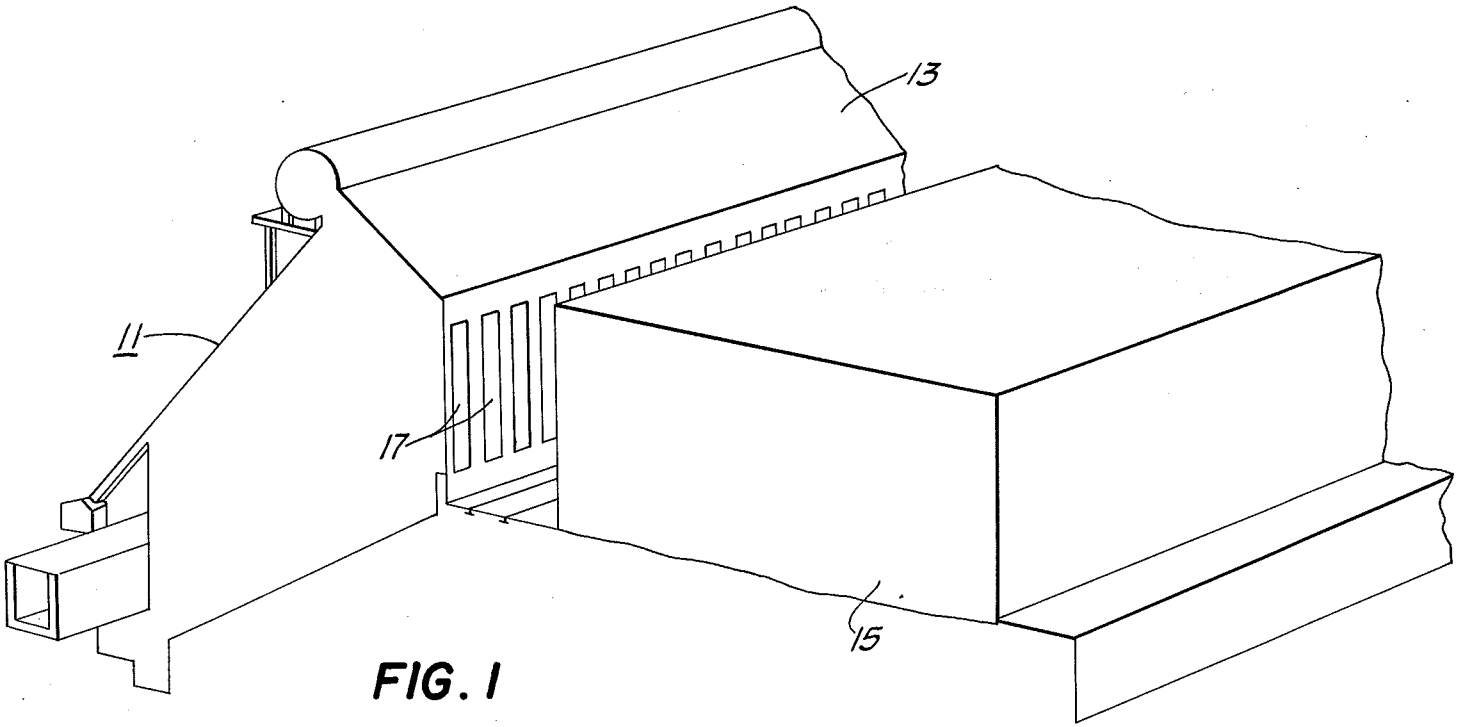
FIG. 1 is a schematic perspective view of apparatus in accordance with the invention as used in association with a coke oven battery.

Referring to FIG. 1, a portion of apparatus 11 in accordance with the invention comprises a shed-like enclosure 13 that is disposed in spaced apart relation to the coke side of a coke oven battery 15. The enclosure 13 has a plurality of vertical doors 17 in the side facing the battery 15, with a door being disposed opposite a coke oven chamber in the battery 15.

Figure 2:
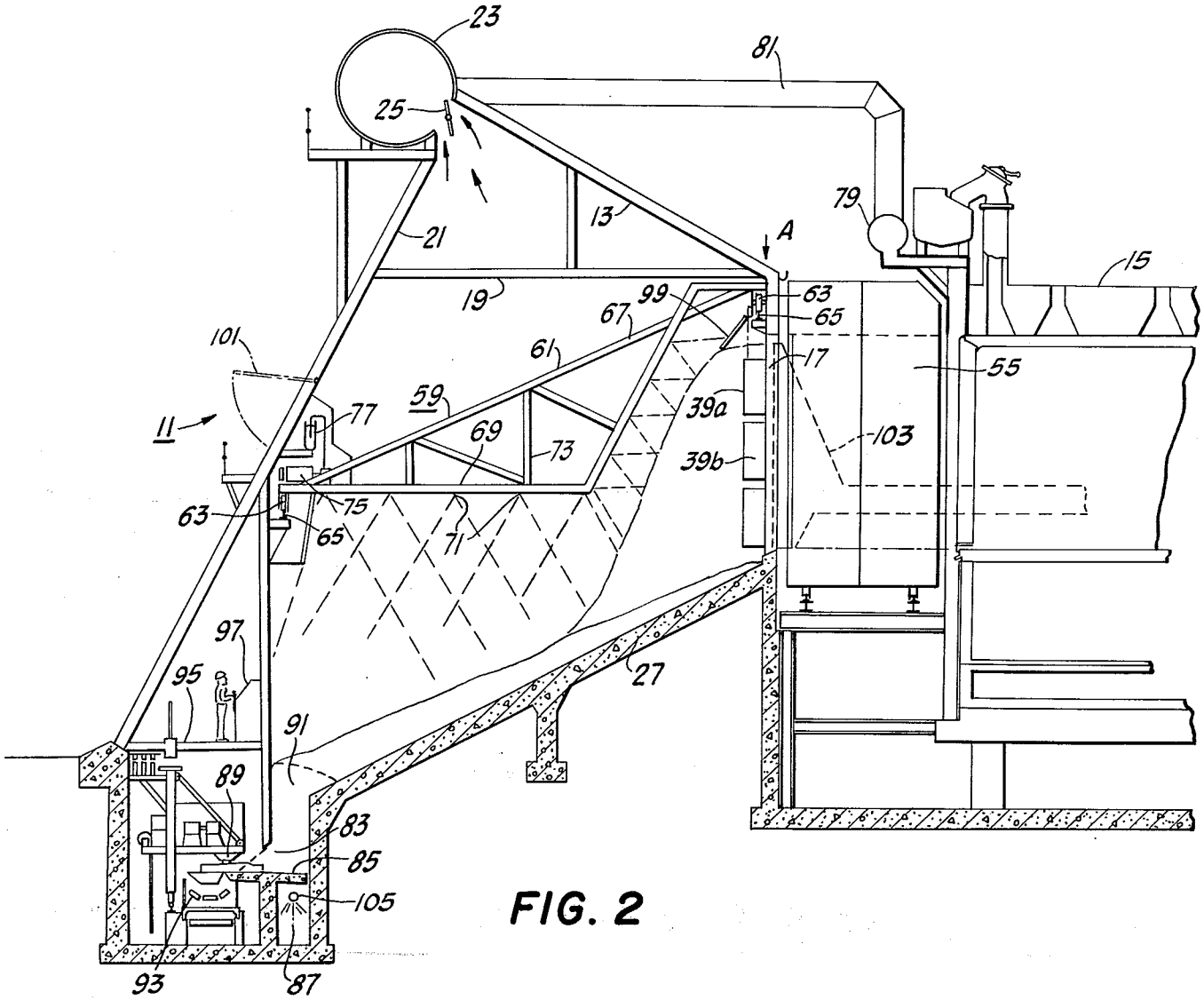
FIG. 2 is a typical transverse sectional view through the apparatus of FIG. 1.

Referring to FIG. 2, which shows a typical cross section through the enclosure 13 and through a portion of the coke oven battery 15, the enclosure 13 comprises a frame structure 19 over which is placed conventional metal sheeting 21. The sheeting 21 at the top connects to an elongate fume collecting main 23 into which flow fumes, dust and the like arising from the coke quenching operation carried out within the enclosure 13 as described hereinafter. At the juncture of the sheeting 21 and the fume collecting main, there are a plurality of pivotable dampers 25 disposed along the length of the enclosure 13. Each damper is individually operable in order to effect zone control of the flow of fumes, dust and the like into the fume collecting main 23 which is connected to a gas scrubber (not shown).

From FIG. 2 it will be seen that the metal siding 21 extends vertically downward on the left hand side of the enclosure to a level below the inclined surface portion of a coke wharf 27. The coke wharf 27 extends for the full length of the coke oven battery 15.

The bottom portion of the metal siding, in the region where the coke on the wharf engages the siding, is of considerably greater thickness than the siding above such region. Additional vertical stiffening of such metal siding may be required in such region.

Figure 3:
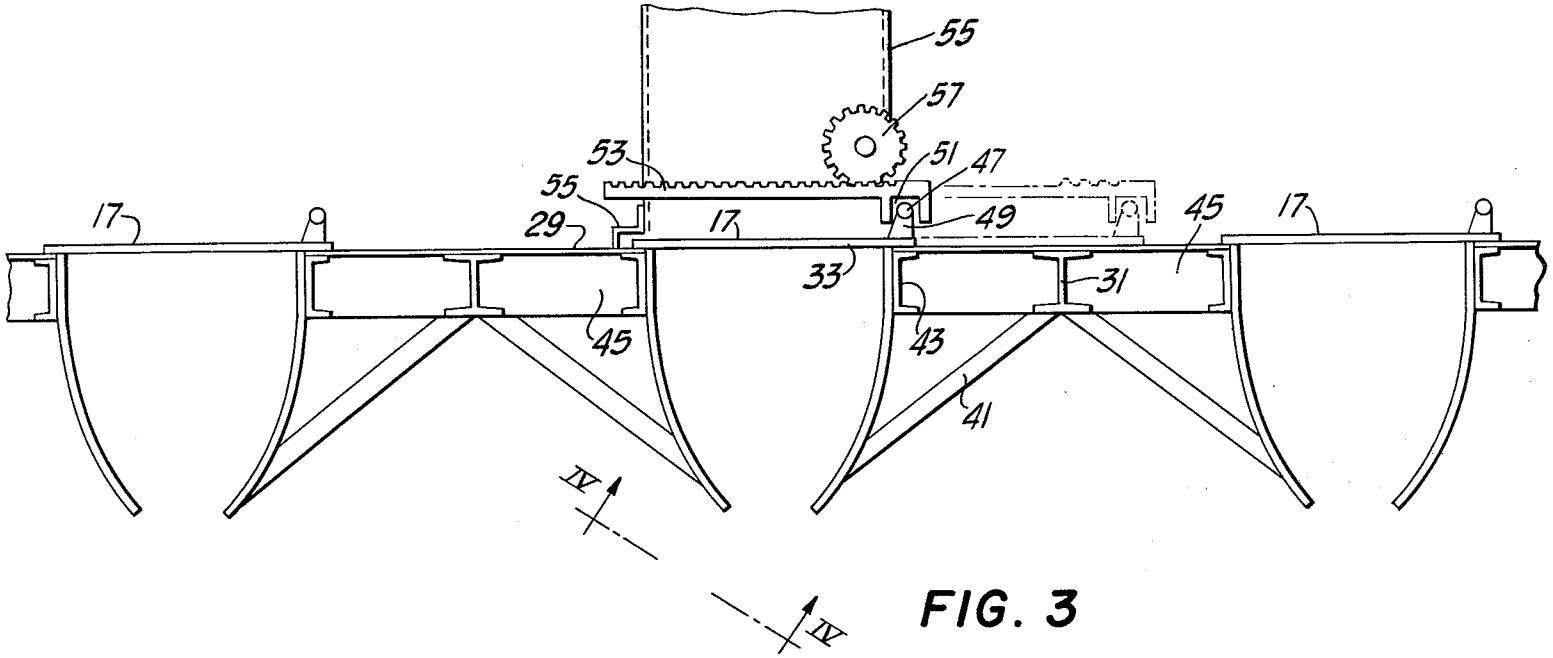
FIG. 3 is a schematic plan view of the apparatus as viewed in the direction of arrow A of Fig. 2.

The front or right hand wall of the enclosure 13, as viewed in FIG. 3 comprises metal sheeting 29 that is supported by vertical I-beams or buckstays 31. The metal siding 29, as mentioned previously, is provided with a plurality of door openings 33; a door opening being opposite a coke oven chamber in the coke oven battery 15. With each door opening 33 there is associated a sliding door 17 which is carried by rollers operating on a track (not shown).

Figure 4:
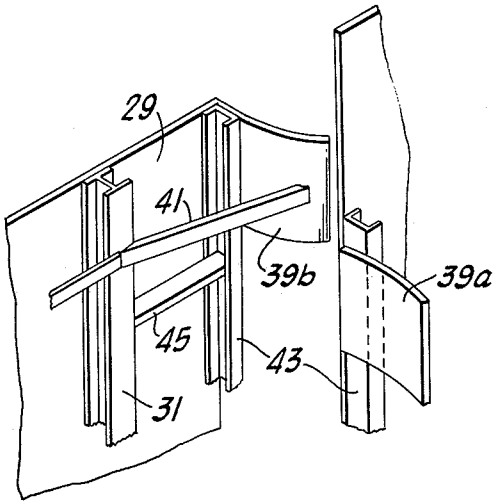
FIG. 4 is a perspective view of the apparatus of FIG. 3 viewed generally along the line IV—IV of FIG. 3.

Each door opening is also associated with a plurality of vertical arcuate deflector plates 39*a* on one side and 39*b* on the opposite side of each door opening 33, as suggested in FIG. 4. The individual arcuate deflector plates 39*a*, 39*b* are braced by a suitable bar 41 connected to the adjacent I-beam or buckstay 31. Each deflector plate 39*a*, 39*b* is supported further along the edge that contacts the sheeting 29 by a structural channel 43. Cross bracing such as an intercostal plate structure 45, provides additional stiffening between each channel member 43 and the adjacent I-beam buckstay 31, as shown in FIG. 3.

Each door 17 has an actuating pin 47 attached to one edge, near the top of the door, which pin is secured to the door by a suitable bracket 49. The pin 47 is so positioned that it fits into groove 51 formed in one end of a rack 53 suitably secured to a conventional coke guide 55 mounted on wheels for movement along the coke side of the battery 15. The coke guide 55 also carries a motorized pinion 57 that coacts with the rack 53. Thus, movement of the rack which coacts with the pin 47 opens and closes the door 17.

Within the shed-like enclosure 13 there are one or more — three would be used in a preferred embodiment of the invention — mobile spray structures 59. Each mobile spray structure includes a truss frame 61 that is mounted at each end to a wheeled carriage 63 coacting with rails 65. The truss frame 61 includes a top chord 67 that is a structural member, such as an I-beam, and a bottom chord 69 that is a conduit carrying a plurality of nozzles 71. Intermediate braces 73 connect together the top chord 67 and the bottom chord 69.

The outer or left-hand end portion of the mobile spray structure, as viewed in FIG. 2, carries a motorized pump 75 that picks up water in a long trough 77 extending along the length of the shed-like enclosure 13, forming the bottom chord 69.

Associated with the coke oven battery 15 is an auxiliary fume collecting main 79 that gathers effluent that leaks from oven doors while coking is being carried out, and that also gathers effluent when the coke side door is removed and before the coke guide 55 is moved into position at the oven to be pushed. One or more conduits 81 connect the auxiliary fume collecting main 79 with the main fume collecting main 23 so that effluent collected in the auxiliary main 79 ultimately passes into the fume collecting main 23, and then passes into the scrubber system.

Adjacent the bottom of the vertical metal siding 21 and below the lower end of the coke wharf 27, there is a coke receiving space or zone 83 bounded by a floor 85 on which quenched coke rests. Below the floor 85 there is a drain trough 87 that collects water and coke breeze that flows down the coke wharf surface during quenching. This trough 87 is sloped to a setting sump and is continually flushed via a sparging header 105 preventing a buildup of coke breeze.

Associated with the floor 85 is a conventional rotary plow mechanism 89 that moves quenched coke from the floor 85 to a conveyor belt 93. Plow 89 operates by a timer until a small portion of quenched coke 91 remains which acts as a seal for the next hot push. At a convenient level above the plow mechanism 89, there is an operating floor 95 on which is located a control console 97 which controls among other things the operation of the mobile spray structures 59. The water flows from the spray nozzles 71 when the coke first passes through the doors 17 and engages a paddle type switch 99 that closes an electrical circuit to energize the motor of pump 75. In the siding 21, at a convenient location above the water trough 77, there is shown one of a plurality of service doors 101 that admit equipment into the enclosure when it is desired or is necessary.

In service, when the coke guide 55, with a telescopic traveling frame, has been positioned and all is in readiness for pushing coke from a coke oven chamber, a pusher ram 103 enters the oven chamber and the coke cake emerges from the coke guide 55. As the coke cake passes through the door 17, the coke cake is broken up by encountering the deflector plates 39*a*, 39*b*. At the same time, the coke cake coacts with the paddle switch 99 and water emerges from the nozzles 71 onto the coke as it falls onto the coke wharf 27. An operator can manipulate controls at the console 97 at proper times during the pushing and quenching sequence, to move the mobile spray structure 59, to control the plow mechanism 89 and to actuate the belt conveyor 93.

After the coke has been pushed and the ram has been retracted, the door 17 can be closed by moving the rack 53. Thereupon, the telescopic coke guide 55 can be moved to the next oven to be pushed and the sequence repeated.

From the foregoing description of one embodiment of the invention, those skilled in the art should recognize many important features and advantages of it, among which the following are particularly significant:

That the shed-like enclosure effects capture of all emissions while coal is being coked, coke is being pushed and quenched, as well as emissions that occur after the coke side door is removed from the oven and before the coke guide is in position, thereby preventing the escape of pollutants to the atmosphere; and That the invention makes it possible to eliminate some conventional coke side equipment, such as: quenching car, locomotive, quenching track and quenching station.

Although the invention has been described herein with a certain degree of particularity, it is understood that the present disclosure has been made only as an example and that the scope of the invention is defined by what is hereinafter claimed.

What is claimed is:

1. In apparatus for quenching hot coke pushed from coke oven chambers through a coke guide onto a coke wharf from which the quenched coke is removed by a rotary plow and a belt conveyor, the combination with said coke wharf of:

a. an enclosure covering said coke wharf and having doors in said enclosure opposite said coke oven chambers;

b. means on said coke guide for opening and closing a door in said enclosure when said guide is aligned with a coke oven chamber to be pushed;

c. at least one movable structure within said enclosure that carries nozzles that emit water for quenching said coke as it falls onto said wharf;

d. means at each door within said enclosure for deflecting said coke as it passes therethrough;

e. means for collecting and removing effluent from said enclosure when coke is quenched within said enclosure; and f. means supplying said water to said nozzles.

2. The invention of claim 1 wherein:

a. said means for collecting is a conduit connected to said enclosure that receives effluent from said coke as it is quenched; and including b. a plurality of dampers that control and regulate the flow of said effluent from said enclosure into said conduit.

3. The invention of claim 1 wherein:

a. said means for deflecting said coke includes a plurality of spaced apart plates arranged vertically on both sides of each said door.

4. The invention of claim 1 including:

a. a second means for collecting positioned above said coke oven chambers that collects and removes effluent from said chambers when doors thereon are removed preparatory to pushing coke from said chambers.

5. The invention of claim 4 including:

a. a conduit communicating said second means for collecting with said means for collecting and removing effluent from said enclosure.

6. The invention of claim 1 including:

a. means within said enclosure that coacts with coke entering said enclosure and activates the flow of water from said nozzles.

7. The invention of claim 6 wherein:

a. said means that coacts with said coke includes a paddle-type switch.

8. In apparatus for quenching hot coke pushed from coke oven chambers through a coke guide onto a coke wharf from which the quenched coke is removed by a rotary plow and a belt conveyor, the combination with said coke wharf of:

a. an enclosure covering said coke wharf and having doors in said enclosure opposite said coke oven chambers;

b. a pinion operated rack on said coke guide that engages a protrusion on a door in said enclosure whereby, when said coke guide is opposite a coke oven chamber to be pushed, said pinion operated rack moves and opens a door opposite said chamber to be pushed;

c. a frame that is movable within said enclosure carrying nozzles from which water is sprayed onto hot coke as it is pushed into said enclosure;

d. a plurality of deflector plates within the enclosure arranged vertically alongside each such door;

e. a first collecting main communicating with said enclosure for receiving and removing effluent from said enclosure;

f. a second collecting main above said coke oven chambers that collects effluent from said chambers when doors thereon are removed preparatory to pushing coke from said chambers;

g. at least one conduit communicating with said first collecting main and said second collecting main;

h. means within said enclosure that coacts with coke entering said enclosure and activates the flow of water from said nozzles; and i. means supplying water to said nozzles.

* * * * *